US005228855A

United States Patent [19]

Frost

[11] Patent Number: 5,228,855

[45] Date of Patent: Jul. 20, 1993

[54] MORTAR TRAINING AMMUNITION DEVICE HAVING INDEPENDENTLY ROTATABLE VENT CLOSURE RINGS

[75] Inventor: John J. Frost, Alexandria, Va.

[73] Assignee: FFE International, Alexandria, Va.

[21] Appl. No.: 861,100

[22] Filed: Mar. 31, 1992

[51] Int. Cl.[5] ..... F41A 33/00

[52] U.S. Cl. ..... 434/12; 434/11; 434/24; 102/445; 102/373

[58] Field of Search ..... 434/12, 11, 13, 24; 102/445, 373; 89/14.5

[56] References Cited

U.S. PATENT DOCUMENTS

| | | | |
|---|---|---|---|
| 3,211,098 | 10/1965 | Stadler et al. . | |
| 3,238,875 | 3/1966 | Stadler et al. . | |
| 3,274,935 | 9/1966 | Stadler et al. . | |
| 3,276,374 | 10/1966 | Stadler et al. . | |
| 3,333,539 | 8/1967 | Stahlmann et al. . | |
| 3,374,738 | 3/1968 | Gawlick et al. . | |
| 3,499,396 | 3/1970 | Stadler et al. . | |
| 3,576,165 | 4/1971 | Gawlick et al. . | |
| 3,611,939 | 10/1971 | Stadler et al. . | |
| 3,948,179 | 4/1976 | Gawlick et al. . | |
| 3,951,037 | 4/1976 | Bornand | 102/373 X |
| 4,549,487 | 10/1985 | Jensen | 102/445 X |
| 4,711,180 | 12/1987 | Smolnik | 102/445 |

FOREIGN PATENT DOCUMENTS

| | | |
|---|---|---|
| 11798353 | 3/1963 | Fed. Rep. of Germany . |
| 1257639 | 7/1968 | Fed. Rep. of Germany . |

*Primary Examiner*—John J. Wilson
*Assistant Examiner*—Jeffrey A. Smith
*Attorney, Agent, or Firm*—Laubscher & Laubscher

[57] ABSTRACT

An improved mortar training ammunition device is characterized by a propulsion module which can be altered for short range and full range operation. The module includes a stabilizer tube containing spaced groups of openings which are selectively opened or closed by rings mounted on the tube. Propelling charges are mounted on the rings. By selecting simulated or active propelling charges and the condition of the openings, the device can be used for garrison or field training.

9 Claims, 2 Drawing Sheets

MORTAR TRAINING AMMUNITION DEVICE HAVING INDEPENDENTLY ROTATABLE VENT CLOSURE RINGS

BACKGROUND OF THE INVENTION

Modern military training, to be effective, requires that the transition from a training mode to a battle mode occur without changing the method of employing ammunition systems.

A satisfactory mortar training system must replicate all functions of the crews engaged in carrying out a battle doctrine. The present invention achieves these goals by providing an accurate mortar training ammunition device. Moreover, the device functions both as a garrison training system and as a full range system through use of interchangeable simulated (i.e. "dummy") and real propelling charges.

BRIEF DESCRIPTION OF THE PRIOR ART

The training of mortar crews has evolved from dry-fire simulation to full crew training. The most reliable mortar training system through the years has been a sub-caliber system produced by Nico Pyrotechnik KG. This system requires distinct, separate charges integrated into the training projectile to achieve the desired ranges and, therefore, does not accurately replicate live-fire functions for mortar crew training.

The POCAL system was developed to address the requirements of full crew training, but is currently flawed with what appear to be insurmountable safety problems.

SUMMARY OF THE INVENTION

Accordingly, it is a primary object of the invention to provide an improved mortar training device which accurately replicates the firing sequence for short range and full range targets. The device comprises a projectile and a unique propulsion module connected with the projectile. The propulsion module includes a cylindrical tube coaxial with the axis of the projectile and containing a plurality of openings adjacent to the remote end of the tube relative to the projectile. The openings are arranged in a plurality of longitudinally spaced groups, with the openings of each group being arcuately spaced about the circumference of the tube. A plurality of rings, one for each group of openings, are mounted on the tube, each ring containing a plurality of vent openings aligned with the tube openings when the ring is in an open position. Each ring is rotatable to a closed position relative to the associated tube openings to selectively open and close the groups of openings. A propelling charge is connected with each ring, and each ring thus corresponds to a zone range of the projectile. Finally, a propellant and piston are arranged in the tube at the end adjacent to the projectile. With the rings positioned to selectively open groups of openings, the propellant is activated to displace the piston through the tube, thereby forcing gas through the opened groups of openings to ignite the propelling charges associated with the opened groups, respectively, in order to propel the projectile toward a target as a full range training projectile.

The propelling charges associated with the rings may comprise active charges for full range employment or simulated charges for short range employment. For maximum short range employment, all vent holes are closed and three simulated horseshoe-shaped charges are attached to the rings. The closing of the vents allows the piston to exert maximum propulsive force and therefore maximum range. If other zone ranges are desired, the appropriate vent holes are opened, reducing the gas pressure and thus reducing the propulsive force of the piston to match the range selected.

The projectile comprises a body formed of composite material and containing a throughbore within which an impact-indicating charge is arranged. At the end of the projectile opposite the propulsion module is provided a fuse for detonating the impact-indicating charge.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
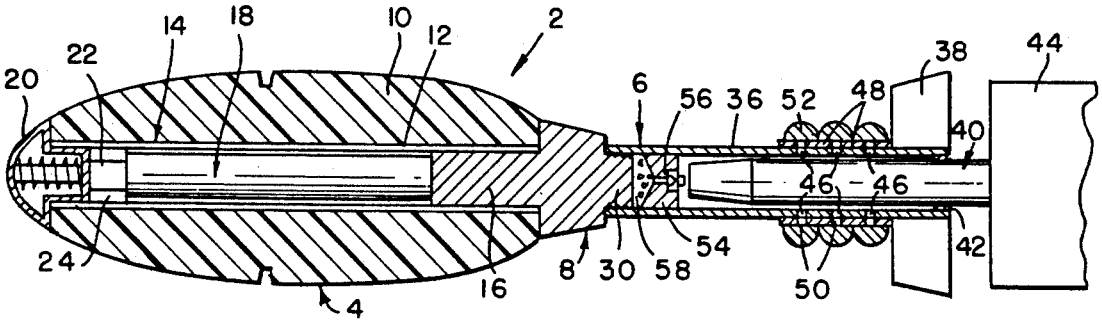
FIG. 1 is a longitudinal sectional view of the mortar training ammunition device according to the invention.

Referring first to FIG. 1, the mortar training ammunition device 2 according to the invention will now be described in greater detail. The device includes a projectile 4 and a propulsion module 6 connected together with a stabilizer 8.

The projectile 4 includes a body 10 having a longitudinal axis. The body is formed of a composite material including at least one of synthetic plastics material, polymer material, cement, and concrete. The body is molded about an axial tube 12 and contains a longitudinal throughbore 14. At the rear end of the body, the throughbore is connected with an upper portion 16 of the stabilizer 8 (FIG. 2) as will be developed below.

Arranged within the projectile tube 12 is a signature charge 18. Projecting from the forward end of the body is a fuse 20 which is connected with a detonator 22 held in place by a holder 24. The fuse is operated to activate the detonator which in turn fires the signature charge as will be discussed in greater detail below.

Figure 2:
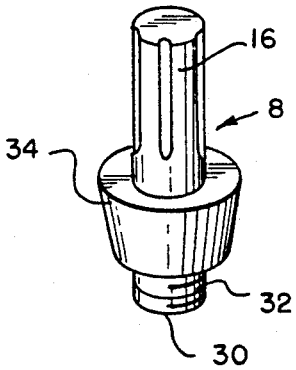
FIG. 2 is a perspective view of a stabilizer used to connect the projectile and propulsion module in the device of FIG. 1.

As shown in FIG. 2, the stabilizer 8 has a unitary construction and includes an upper tubular projection 16 which is slotted 26 and a lower cylindrical projection 30 thus containing threads 32. The stabilizer is formed of a synthetic plastic material or a suitable metal such as aluminum or a combination of the two. The main body 34 of the stabilizer is fairly rigid. Referring once again to FIG. 1, the mortar training ammunition device is assembled by inserting and wedging the upper projection 16 of the stabilizer into the projectile throughbore 14. The propulsion module 6 is threadably connected with the lower projection 30 of the stabilizer by inserting the stabilizer lower projection into a threaded forward end of a stabilizer tube 36 of the module. The stabilizer thus guarantees that the propulsion module is retained coaxially with the projectile.

The propulsion module stabilizer tube 36 has a plurality of fins 38 at its rear end. The tube is mounted on a spigot 40 via the open rear end of the tube. A stabilizer ring 42 stabilizes the propulsion module with respect to the spigot. The spigot in turn is connected with a recoil base 44.

The stabilizer tube contains a plurality of radial openings 46 in the side wall thereof above the fins 38. The openings are arcuately spaced about the circumference of the tube and are arranged in a plurality of longitudinally spaced groups. In FIG. 1, three groups are shown although any suitable number of groups may be provided.

Figure 3:
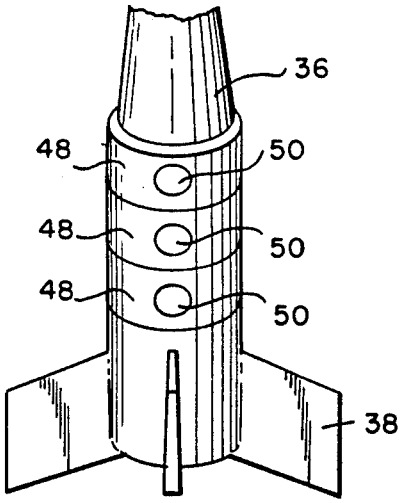
FIG. 3 is partial detailed plan view of the selectively operated rings of the device of FIG. 1.

As shown more particularly in FIG. 3, a plurality of annular rings 48 are mounted on the stabilizer tube corresponding in number to the number of groups of openings in the tube. Each ring is rotatable with respect to the tube and contains a plurality of vent openings 50 corresponding in number and location with the tube openings of the associated group. Thus, each ring can be rotated to either open or close the tube openings of the associated group.

Referring once again to FIG. 1, there is provided a propelling charge 52 having a horseshoe configuration arranged in contiguous relation with and rotatable with respect to the outer surface of each of the rings 48. Thus, for the three groups of openings in the stabilizer tube shown in FIG. 1, there are three rings and three propelling charges. The propelling charges may comprise either active of simulated charges.

Within the forward end of the stabilizer tube is provided a piston 54 having an outer diameter corresponding with the inner diameter of the tube. The piston includes a primer 56 of the impact or electric type. The piston is slidable within the tube and contains a concave top surface which defines a space beneath the stabilizer lower projection 30 within which a precise quantity of propellant 58 is arranged.

The mortar training ammunition device of the invention is of the same size, weight, and configuration of mortar service ammunition from calibers of 40 mm to 200 mm. This full size device can be used interchangeably by trainees for both garrison (short range) and field (full range) training. For garrison training, no propelling charges are required and firing distances of approximately 1/10 of the range of the service ammunition are obtained. For field training, additional propelling charges are added and ignited by the propulsion module to increase the range in order to match the range of the service ammunition. Moreover, although the device is inexpensive (i.e. 25% of the cost of the service round), it can be reloaded.

OPERATION

Figure 4:
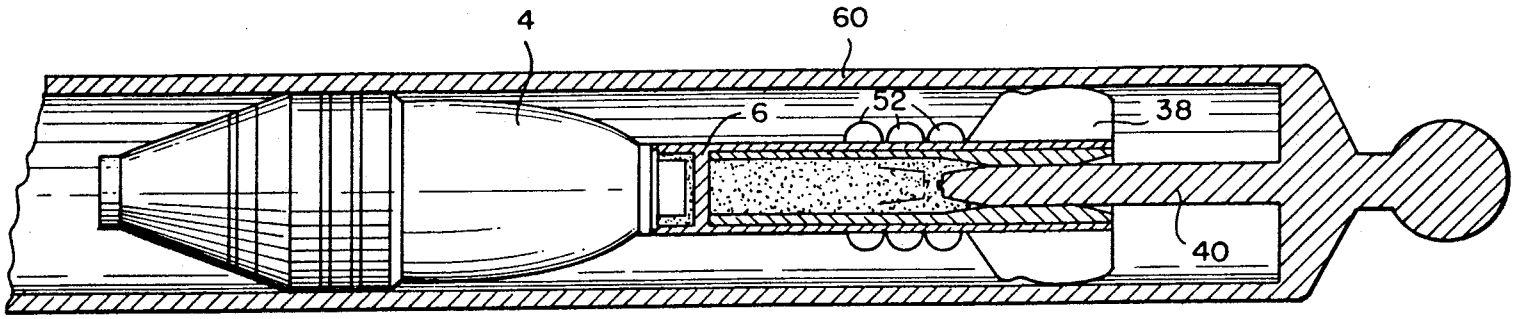
FIG. 4 is a longitudinal view of the device of FIG. 1 following ignition of the propellant.
Figure 5:
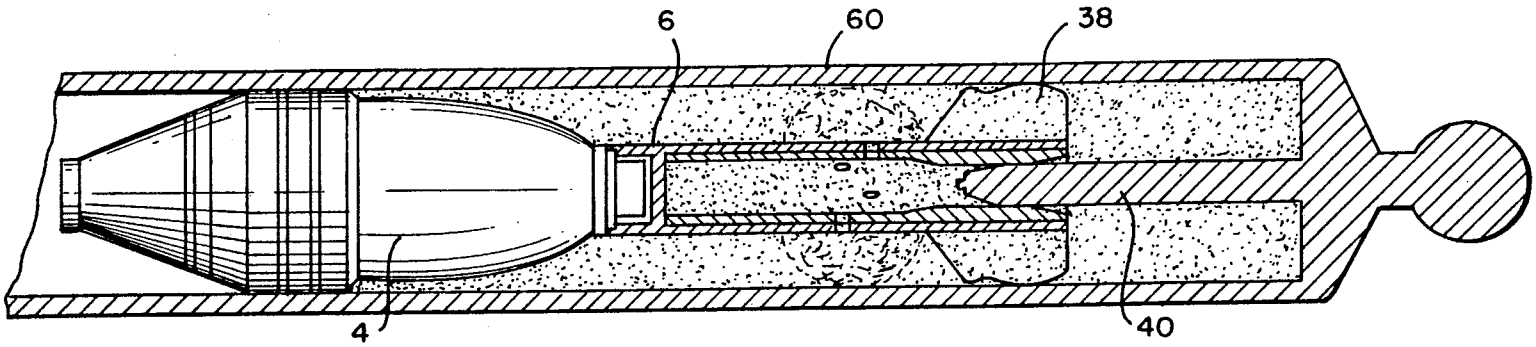
FIG. 5 is a longitudinal view of the device of FIG. 1 following ignition of the propelling charges.

The operation of the mortar training ammunition device will be described with reference to FIGS. 4 and 5. For short range operation, dummy propelling charges are arranged on the rings of the propulsion module. The mortar team selects the desired range. For full deployment (within the short range), the team rotates the closure rings to seal the corresponding openings in the stabilizer tube which will result in maximum pressure delivered from the propulsion module and, consequently, maximum velocity. This corresponds to the employment of three horseshoe propellant charges. Three dummy charges are placed over the closure rings, one over each ring. A transport safety ring (not shown) is removed from the fuze and the mortar round is ready to use. The round is dropped down the mortar tube 60 until the primer in the piston impacts on the firing pin of the spigot.

The piston primer ignites the propellant which converts to a gas and expands adiabatically. This causes the piston to react with great force against the spigot, thus providing forward momentum to the complete mortar round as shown in FIG. 4.

The mortar achieves a precise initial or muzzle velocity, which allows for consistent ranging at approximately one-tenth the full service range.

The mortar round continues down range until impact. At impact, the fuse activates the detonator to ignite the signature charge. This produces an instantaneous high pressure which expels the propulsion module from the projectile throughbore, thus releasing into the air a smoke cloud, a flash and a bang from the signature charge.

Range can be varied by venting gas through one or more rings. The objective of venting the gas from the propulsion module is to reduce the pressure on the piston and, consequently, on the spigot to reduce the velocity of the mortar round. Each vent is specifically sized to provide venting of the exact amount of gas to provide for precise control of velocity.

For full range operation, the procedures are the same except that the simulated propelling charges are replaced with active charges.

To achieve maximum range, the vent holes are aligned in the open position. The propelling charges are aligned with the holes. When the propulsion module is activated, the piston moves past the vent holes, expelling high temperature gas which ignites the propelling charges. The propulsion module provides the initial velocity so that the propelling charges are ignited in sequence as shown in FIG. 5 providing high volume, high pressure inside the mortar, thereby creating a muzzle velocity to achieve maximum range. Intermediate range is controlled by the number of propelling charges employed. All other functions remain the same as described in the procedure for short-range training.

While in accordance with the provisions of the patent statute and the preferred forms and embodiments have been illustrated and described, it will be apparent to those of ordinary skill in the art that various changes and modifications may be made without deviating from the inventive concepts set forth above.

What is claimed is:

1. A mortar training ammunition device, comprising (a) a projectile having a longitudinal axis; and (b) a propulsion module connected with said projectile, said propulsion module including (1) a cylindrical tube coaxial with said projectile and containing a plurality of openings adjacent to an end of said tube remote from said projectile, said openings being arcuately spaced about the circumference of said tube and being arranged in a plurality of longitudinally spaced groups;

(2) means for selectively opening and closing said groups of openings comprising a plurality of rings rotatably mounted on said tube and containing a plurality of arcuately spaced openings, whereby said rings can be independently rotated to align said vent openings with said tube openings and to block said tube openings to allow for employment at various ranges;

(3) at least one propelling charge having a partial annular configuration and arranged in contiguous relation with the outer surface of one of said rings; and (4) propulsion means arranged in the other end of said tube adjacent to said projectile, whereby when said rings are rotated to selectively open said groups of openings and when said propulsion means are activated, gases are generated in said tube and expelled from said open groups of opening to ignite a propelling charge associated with said opened group of openings and propel said projectile toward a target.

2. A mortar training ammunition device as defined in claim 1, wherein a propelling charge is provided for each ring, respectively.

3. A mortar training ammunition device as defined in claim 2, wherein said propulsion means comprises a piston having a diameter corresponding with the inner diameter of said tube, said piston containing an ignition device.

4. A mortar training ammunition device as defined in claim 3, wherein said propulsion means further comprises a quantity of propellant arranged between said piston and said projectile.

5. A mortar training ammunition device as defined in claim 4, wherein said propelling charges comprise one of active charges for full range employment and simulated charges for short range employment.

6. A mortar training ammunition device as defined in claim 5, wherein said projectile comprises a body of composite material containing an axial throughbore.

7. A mortar training ammunition device as defined in claim 6, wherein said projectile includes a detonation fuse at an end opposite said propulsion module.

8. A mortar training ammunition device as defined in claim 7, wherein said projectile contains impact indicating means arranged within said throughbore and activated by said detonation fuse when said projectile strikes a target.

9. A mortar training ammunition device as defined in claim 8, and further comprising stabilizer means for connecting said propulsion module with said projectile.

* * * * *